US006138858A

United States Patent [19]

Tu

[11] Patent Number: 6,138,858

[45] **Date of Patent: *Oct. 31, 2000**

[54] PORTABLE TOTE WITH ASSEMBLY SURFACE

[75] Inventor: Lily K. Tu, Brookings, S. Dak.

[73] Assignee: Gateway 2000, Inc., North Sioux City, S. Dak.

[ * ] Notice: This patent issued on a continued prosecution application filed under 37 CFR 1.53(d), and is subject to the twenty year patent term provisions of 35 U.S.C. 154(a)(2).

[21] Appl. No.: 09/069,667

[22] Filed: Apr. 29, 1998

[51] Int. Cl.[7] ..... B65D 25/04

[52] U.S. Cl. ..... 220/529; 220/505; 206/716; 206/725

[58] Field of Search ..... 206/723, 725, 206/722, 719, 701, 569, 372, 373; 220/529, 505, 503

[56] References Cited

U.S. PATENT DOCUMENTS

| | | | |
|---|---|---|---|
| Re. 32,966 | 6/1989 | Miller et al. | 206/328 |
| 224,490 | 2/1880 | Sturges | 220/503 |
| 2,671,239 | 3/1954 | Wisner | 220/505 |
| 3,656,650 | 4/1972 | Frater | 220/22.3 |
| 3,915,307 | 10/1975 | Agarde | 211/41 |
| 4,139,138 | 2/1979 | Besselman, Jr. | 228/57 |
| 4,158,876 | 6/1979 | Pedro | 361/415 |
| 4,171,049 | 10/1979 | Nohara et al. | 206/328 |
| 4,426,675 | 1/1984 | Robinson et al. | 361/415 |
| 4,499,997 | 2/1985 | Swingley, Jr. | 206/509 |
| 4,513,046 | 4/1985 | Waniek et al. | 428/156 |
| 4,602,715 | 7/1986 | Sarver et al. | 206/523 |
| 4,626,050 | 12/1986 | Davis | 312/293 |
| 4,807,760 | 2/1989 | Sussman | 206/581 |
| 4,884,689 | 12/1989 | Su-Chin | 206/372 |
| 4,977,483 | 12/1990 | Perretta | 361/424 |
| 5,167,343 | 12/1992 | Winfrey et al. | 220/529 |
| 5,261,561 | 11/1993 | Hodges, Jr. | 220/735 |
| 5,593,061 | 1/1997 | Prochnow | 220/505 |

*Primary Examiner*—Stephen Castellano
*Attorney, Agent, or Firm*—Schwegman, Lundberg, Woessner & Kluth, P.A.; Anthony Claiborne

[57] ABSTRACT

A portable tote container is provided with an open box configuration. Divider panels and a work surface are disposed within the container. The divider panels allow for parts to be organized within the tote container. The work surface has an outer layer of anti-static material and is configured to couple with the divider panels. The work surface has an inner layer of alternative, less expensive material, which has a cavity formed inside. The cavity houses complete or partially complete components and creates an additional storage space within the container. The work surface is also movable in that it slides over the divider panel to cover the divider panels and to create additional work surface area.

8 Claims, 7 Drawing Sheets

PORTABLE TOTE WITH ASSEMBLY SURFACE

FIELD OF THE INVENTION

The present invention relates generally to computer manufacturing devices. More particularly, it pertains to a tote container with an assembly surface.

BACKGROUND OF THE INVENTION

Tote boxes are extensively used in manufacturing facilities for material handling applications including carrying raw materials, work in process or finished manufacturing goods. Generally, tote boxes are known in the art and are typically cardboard boxes having separate compartments or metal/plastic containers containing a plurality of stacked drawers. Such types of tote boxes have operated successfully in the past.

The assembly of electronic systems typically requires that numerous parts be arranged and be available to an assembly operator in a manner which is conducive to minimizing assembly time by providing for easy identification, part segregation and control of the materials used by the assembly. This operation of organizing material is known as "kitting" and the part containers used in this operation are referred to as "kit boxes". However, as technology has advanced, and as components of circuits have become smaller, potential damage to components due to electrostatic discharge has increased and has therefore become a major concern in the manufacturing process. It was necessary to minimize electrostatic discharge and to remove static generators from the work area.

Some variations on the tote boxes include U.S. Pat. No. 4,499,997 issued to Swingley on Feb. 19, 1985 which teaches a tote box provided with a bumper disposed a short distance from the tote bottom. Another tote box is described in U.S. Pat. No. Re. 32,966 to Miller on Jun. 27, 1989 which describes a series of tote boxes which may be extended in height by securely fastening a ring on top of the box.

In using the tote boxes with the organized parts therein, an operator requires an assembly surface which is large enough to accommodate both the tote box and the component to be assembled. While a cart may be provided to hold the tote box while the operator is assembling the component, the cart requires additional valuable floor space in the manufacturing facility. In addition, the cart would be spaced away from the assembly surface, which would allow for parts to fall from the operator's grasp and onto the floor as parts are transferred from the tote box to the assembly surface. Parts which fall to the floor become damaged from the fall or from the operator stepping on them. Extra part loss would unnecessarily increase manufacturing costs. Accordingly, what is needed is an improved tote box for both organization and assembly of kitted parts. What is also needed is a way to decrease the loss of parts during the manufacturing process.

SUMMARY OF THE INVENTION

A portable tote container is provided with dividers and a work surface panel. The dividers form spaces in between them or between the dividers and side surfaces of the portable tote. In other embodiments, anti-static foam is disposed under the dividers so that the spaces are cushioned and electronic parts inserted therein are safe from electrostatic discharge. The work surface panel can be removable, and is disposed parallel to a bottom surface of the container. Alternatively, the work surface panel is secured to side surfaces and/or the bottom surface of the portable tote container. In another embodiment, the work surface panel is disposed adjacent to at least some of the dividers such that an operator can have access to at least some of the spaces between the dividers and the work surface panel simultaneously. The work surface panel is comprised of an anti-static foam, and has, in another embodiment, support material under the anti-static foam. In another configuration of the above container, a cavity or a plurality of cavities are formed in side surfaces of the portable tote container. The cavity provides additional storage for partially assembled parts, or for larger components.

In another embodiment, a portable tote container has a main body with side surface and a bottom surface. At least one divider panel and a movable work surface panel are provided in the main body. As the work surface panel is moved by an operator, the work surface panel covers at least a portion of the divider panels. In addition, as the work surface panel is moved, another work surface is created by material beneath the work surface panel.

The portable tote container has a work surface coupled therewith so that an operator will have sufficient work space, and will have a work space which is integral with the container. In addition, the raised level of the work surface raises the surface to a level which is easier to work at. A further benefit is that an operator has access to an anti-static work surface without having to worry about finding an appropriate surface. The work surface also provides a less abrasive surface on which to assemble parts, where the work surface will not scratch nor damage the new parts. This is particularly important for devices which are repeatedly flipped during the assembly process or devices which are particularly delicate. The cavity also provides temporary storage for assemblies which have only been partially assembled.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the spirit and scope of the present invention. Therefore, the following detailed description is not to be taken in a limiting sense, and the scope of the present invention is defined by the appended claims.

Figure 1:
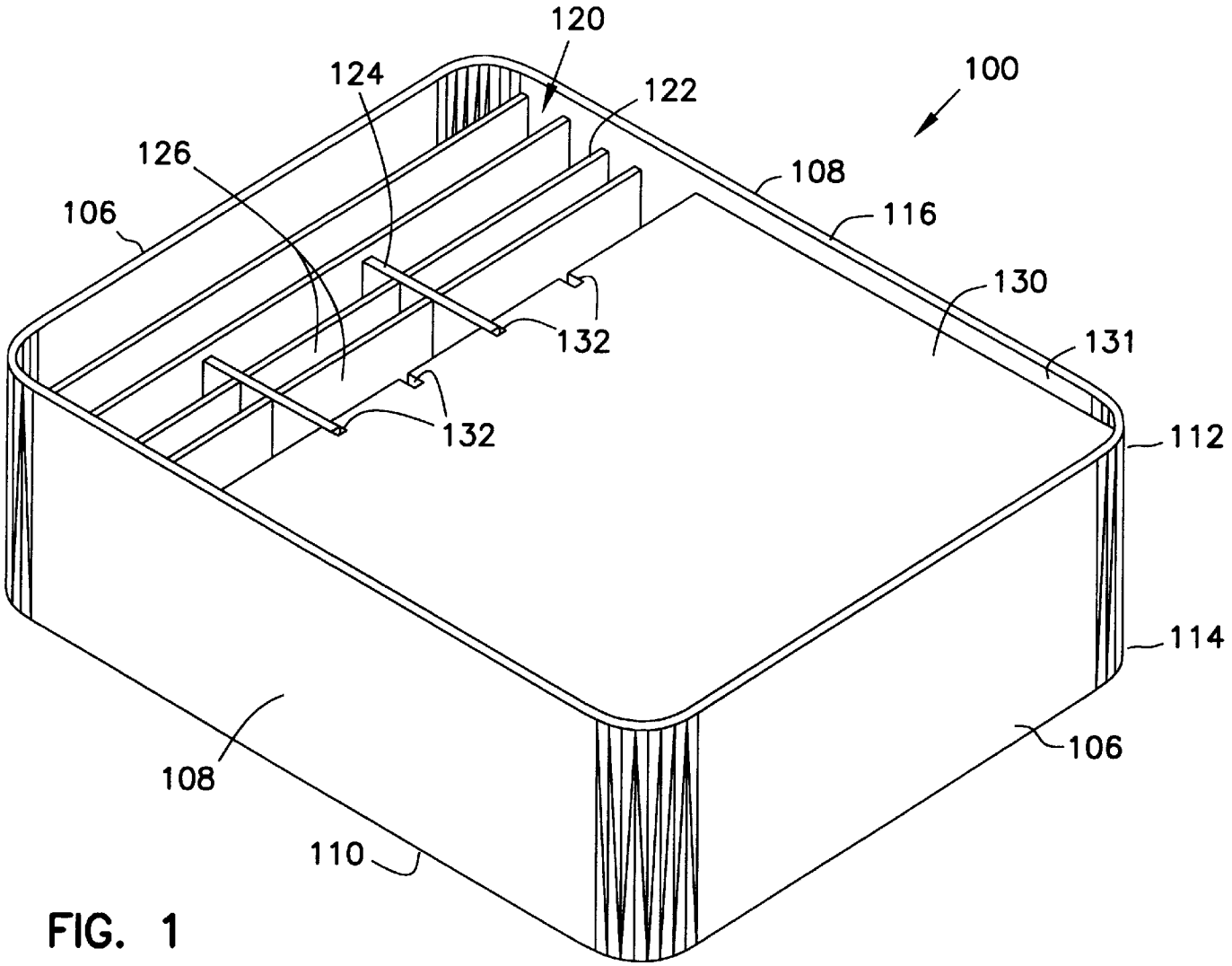
FIG. 1 is a perspective view illustrating a portable tote container constructed in accordance with one embodiment of the present invention.

FIG. 1 illustrates a first embodiment of a portable tote container 100. The portable tote container 100 comprises a first set of side surfaces 106 and a second set of side surfaces 108 coupled with a bottom surface 110. The first set of side surfaces 106 and the second set of side surfaces 108 are coupled with the bottom surface 110 such that they form an open box container having a top surface 116. In one embodiment, the first set of side surfaces 106 are comprised of a substantially rigid material and are disposed parallel to one another. Similarly, the second set of side surfaces 108 are also disposed parallel to one another opposite the bottom surface 110. The side surfaces 106, 108 extend up to a height where they form an upper portion 112 and extend down to a lower portion 114 as marked in FIG. 1. Also disposed within the portable tote container 100 are a work surface panel 130 and divider panels 120.

The divider panels 120 are disposed in the portable tote container 100 such that, in one embodiment, they extend between either the first set of side surfaces 106 or the second set of side surfaces 108. Although a plurality of divider panels 120 are shown in FIG. 1, only one divider panel may be necessary. In addition, the divider panels 120 could be spaced such that a certain size can be achieved in between the divider panels 120. In one embodiment, the divider panels 120 comprise a first set of divider panels 122 and a second set of divider panels 124. The first set of divider panels 122 and the second set of divider panels 124 can be placed in a perpendicular relationship to one another such that they form sections 126 therebetween. As more divider panels 120 are disposed within the portable tote container 100, additional sections 126 can be formed therein. The additional sections 126 allow for more parts to be accumulated within the portable tote container 100 and be maintained in an organized manner.

In one embodiment, the second set of divider panels 124 couple with the work surface panel 130, as will be discussed further below. The divider panels 120 are also disposed within the portable tote container 100 such that they are, in one embodiment, perpendicular with the bottom surface 110. In addition, the divider panels 120 can be placed such that they are perpendicular to the first set of divider panels 122 or the second set of side surfaces 108. The divider panels 120 can be formed from either rigid material or non-rigid material, and/or anti-static material. Additionally, the divider panels may extend partially up from the bottom surface of the portable tote container 100. Alternatively, the divider panels 120 extend from the bottom surface 110 all the way up to or above the upper portion 112 of the portable tote container 100.

Figure 7:
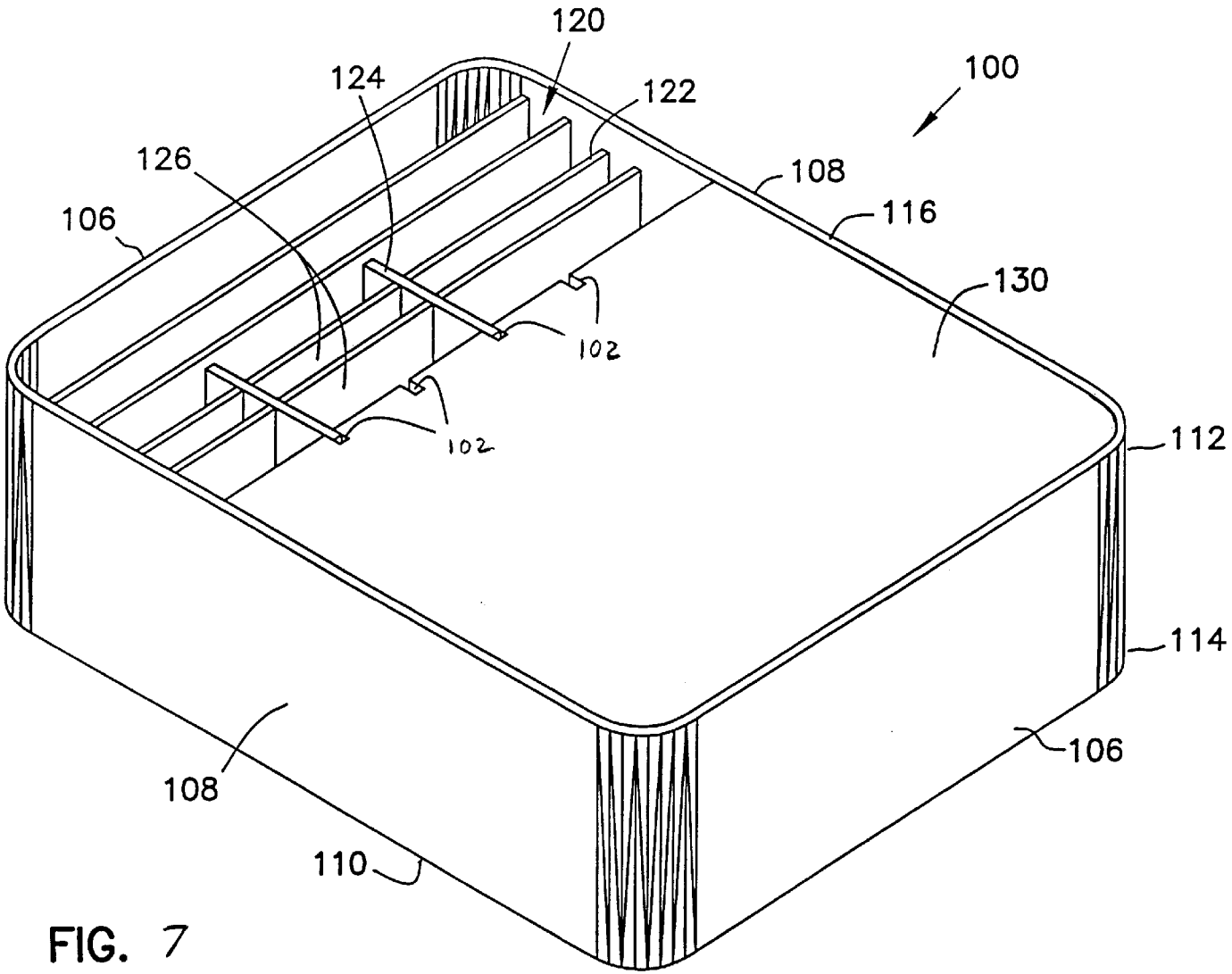
FIG. 7 is a perspective view illustrating a portable tote container constructed according to another embodiment of the present invention.

A work surface panel 130 is comprised of, in one embodiment, a flat planar panel which is disposed within the portable tote container 100 such that the work surface panel 130 is generally parallel with the bottom surface 110. The work surface panel 130 is disposed within the portable tote container 100 such that a ridge 131 is formed around the work surface panel 130. The ridge 131 assists in preventing parts from rolling off of the work surface panel 130 on onto the floor. Alternatively, the work surface panel 130 can have other configurations which may depend on the type of part which is assembled thereon. The work surface panel 130 is disposed within the portable tote container 100 such that, in one embodiment, an operator can access the work surface panel 130 and at least some of the divider panels 120 simultaneously. For instance, the work surface panel 130 can be disposed adjacent to all of the dividers 120, or the work surface panel 130 can cover some of the divider panels 120. In one embodiment, the work surface panel 130 is disposed proximate the upper portion 112 of the portable tote container 100. Alternatively, as shown in FIG. 7, work surface panel 130 is disposed within the portable tote container 100 such that the work surface panel 130 is substantially flush with a top surface 116 of the portable tote container 100. In one embodiment, the work surface panel 130 is recessed from the top surface 116. Having the work surface panel 130 slightly recessed within the portable tote container 100 assists in preventing parts from rolling off the work surface and onto the floor.

Work surface panel 130 is secured to at least a portion of the portable tote container 100. For instance, the work surface panel 130 is secured to the bottom surface 110. Alternatively, the work surface panel 130 can be attached to either the first set of side surfaces 106 or the second set of side surfaces 108 or both. Alternatively, the work surface panel 130 can be removable. A removable work surface panel 130 allows for a customized work surface panel to be provided for the particular portable tote container 100 or for a particular product to be assembled on the work surface panel. As mentioned earlier, the work surface panel 130 couples with the second set of divider panels 124. To accommodate the second set of divider panels 124, the work surface panel 130 has at least one cutout 102. The cutout 102 is sized to receive the second set of divider panels 124 therein. The cut out 2 allows the divider panels 120 to be repeatedly removed and inserted without damage to either the divider panels 120 or the work surface panel 130. A further advantage of the cut out 102 is that the divider panels 120 can be re-configured to form many different sized spaces therebetween.

Figure 2:
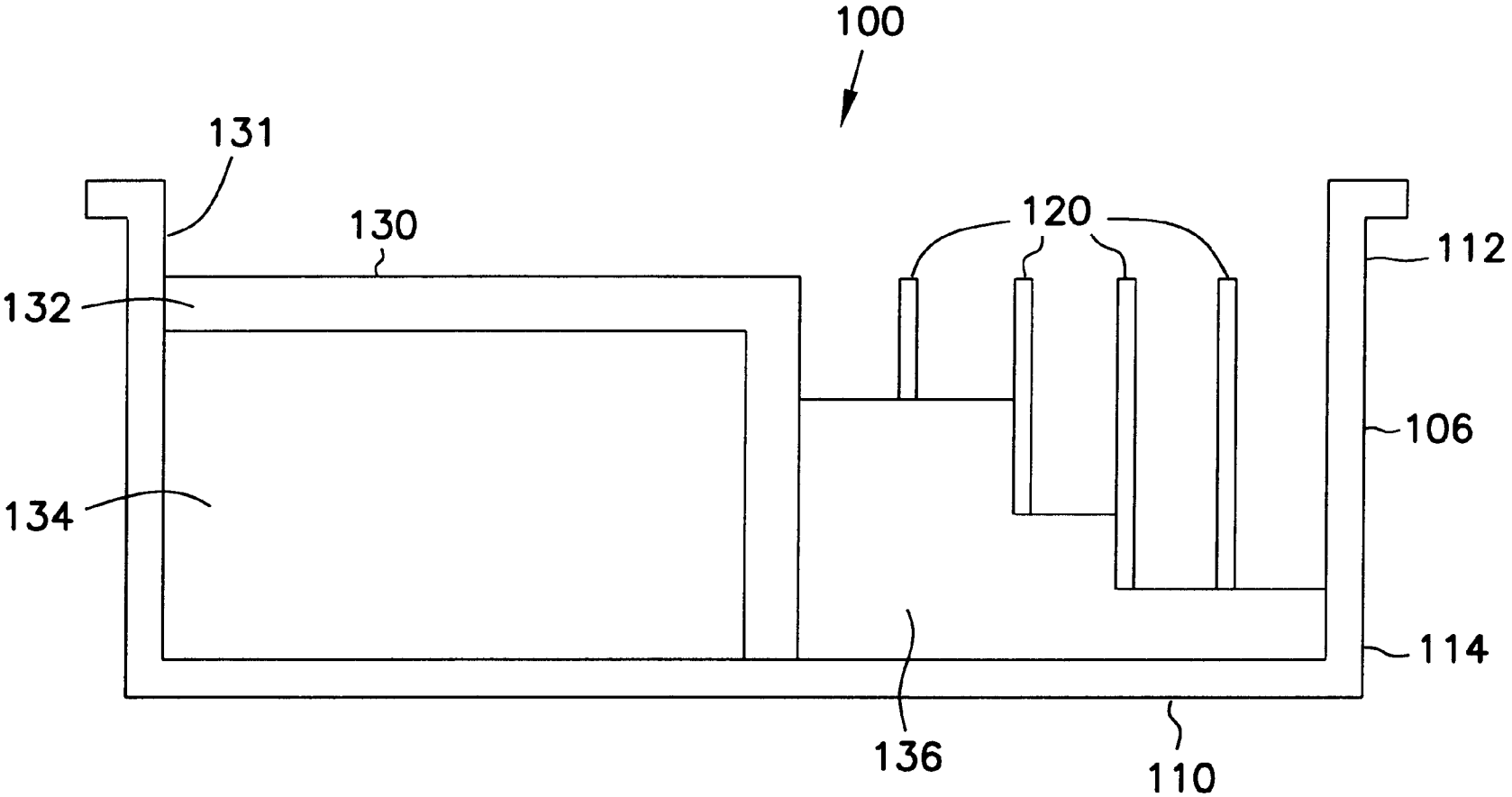
FIG. 2 is a cross-sectional view of another embodiment of a portable tote container according to the present invention.

FIG. 2 shows a cross-sectional view of another embodiment of the portable tote container 100. The portable tote container 100 has a first set of side surfaces 106 and a bottom surface 110 which forms the open box. Similar to the first embodiment, dividers 120 and a work surface panel 130 are disposed within the portable tote container 100. In this embodiment, the work surface panel 130 has a top layer of material 132 and support material 134. The top layer of material 132 actually forms the work surface on which parts are assembled. Since sensitive electronic parts are sometimes assembled on the work surface panel 130, antistatic foam can be used for the top layer of material 132. For the support material 134, styrofoam or another type of inexpensive material may be used. For the support material 134, a sturdier or more rigid material could also be used to provide additional support to the work surface panel 130. Alternatively, a less expensive material could also be used for the support material 134. Again, similar to the first embodiment, the work surface panel 130 can be secured to either the bottom surface 110, the first set of side surfaces 106 or the second set of side surfaces 108. Alternatively, the work surface panel 130 can be removable from the portable tote container 100. A removable work surface panel 130 could be coupled with the portable container 100 in a variety of manners. For instance, the removable work surface panel 130 could be coupled to the portable container 100 using a hook and loop fastener material.

In another embodiment, divider support material 136 is disposed in a lower portion 114 of the portable tote container 100. The dividers 120 are disposed on top of the divider support material 136. The divider support material 136 can have different levels as shown in the Figure to provide different volumes of cavities within the dividers 120. The divider support material 136 can be secured to the bottom surface 110 or the first set of side surfaces 106 of the portable tote container 100. Alternatively, the divider support material 136 can be removable from the portable tote container 100 such that additional configurations can be made. The divider support material 136 is comprised of a cushioning foam, such as a styrofoam or an open-cell foam. Alternatively, the divider support material 136 can also be comprised of antistatic foam to help protect the electronic parts that are disposed between the dividers 120.

Figure 3:
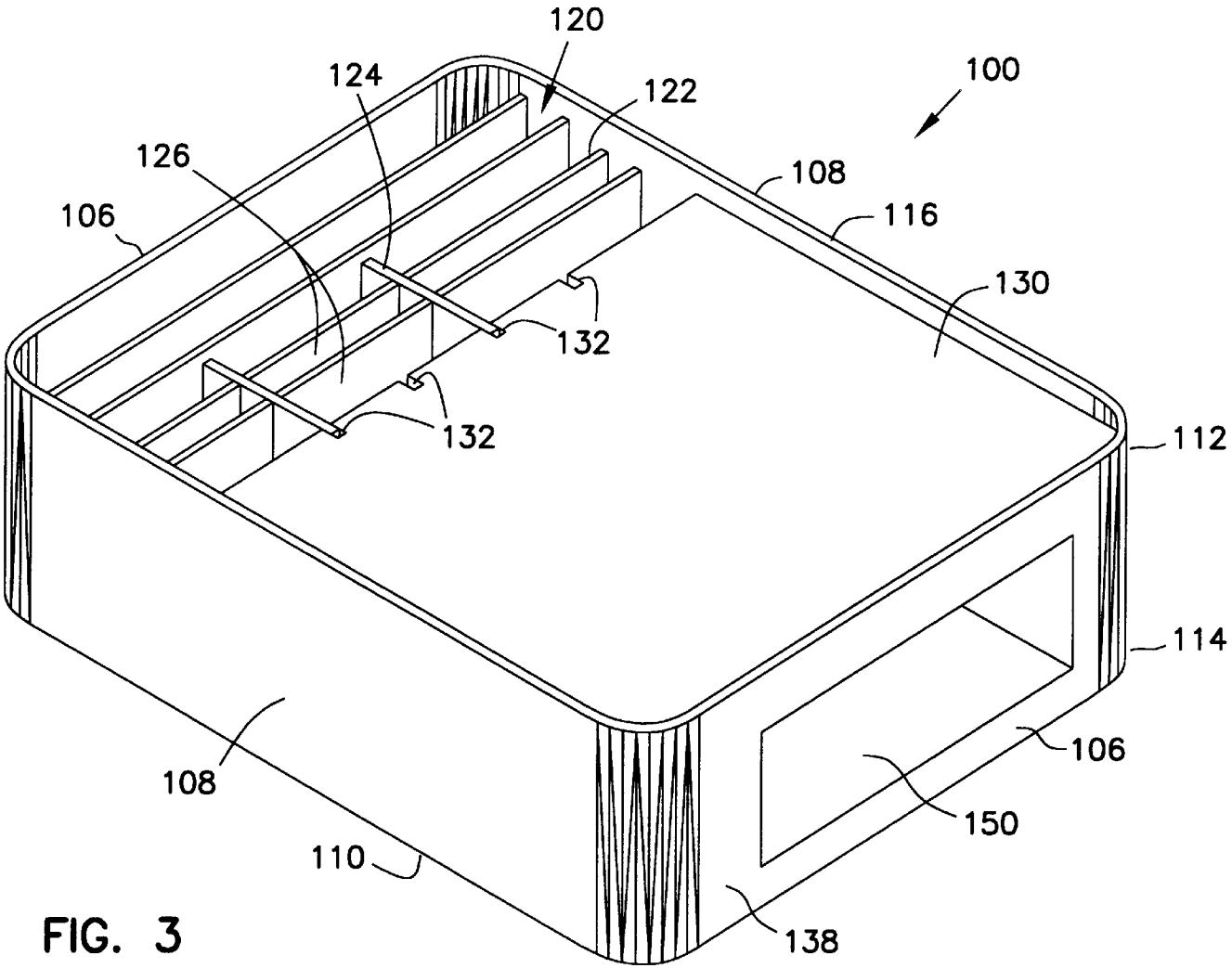
FIG. 3 is a perspective view illustrating a portable tote container constructed in accordance with another embodiment of the present invention.
Figure 4:
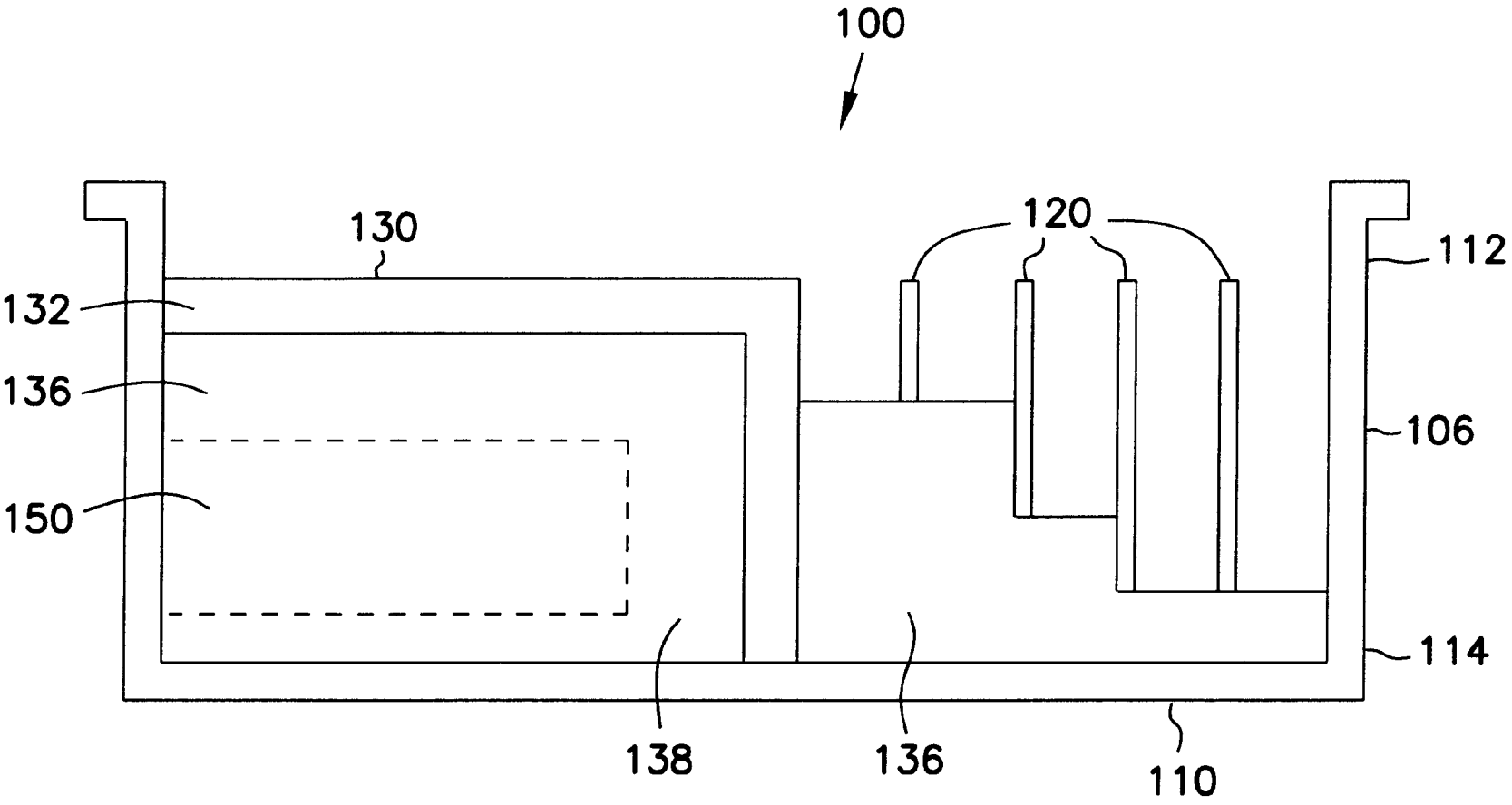
FIG. 4 is a cross-sectional view illustrating the portable tote container illustrated in FIG. 3.

FIGS. 3 and 4 illustrate yet another embodiment of the portable tote container 100. The portable tote container 100 has a first set of side surfaces 106 and a second set of side surfaces 108 coupled with a bottom surface 110 to thereby form an open box, similar to the previously discussed embodiments. Disposed within the portable tote container 100 is a work surface panel 130 and divider panels 120. The work surface panel 130 is comprised of material which extends down to the bottom surface 110 of the portable tote container 100. The work surface panel 130 is comprised of a top layer of material 132 and support material 134. The support material 134 has a cavity 150 therein. The cavity 150 extends from a rear portion 138 of the support material 134 and through one of the first set of side surfaces 106. For this embodiment, the support material 134 shall be rigid enough to accommodate the size of the cavity 150. For a more deeply recessed cavity 150, the support material 134 should be more sturdy to provide sufficient structural support to the work panel 130. For a more shallow cavity 150, a less rigid support material 134 can be used. Alternatively, additional support structure can be added to accommodate the cavity 150. The cavity 150 is sized and shaped to receive partially or fully assembled parts therein. In one embodiment, the cavity 150 is large enough to receive a portable computer therein. In addition, a door member could also be provided which is coupled within the cavity or with one of the first set of side surfaces 106 for closing off the cavity 150. In yet another embodiment, a plurality of cavities 150 can also be provided within the work surface panel 130. The cavity 150 provides a convenient place to store assemblies which are partially or fully completed. Alternatively, the cavity 150 can be used during the kitting process for larger components which are too large to fit between the dividers 120.

Figure 5:
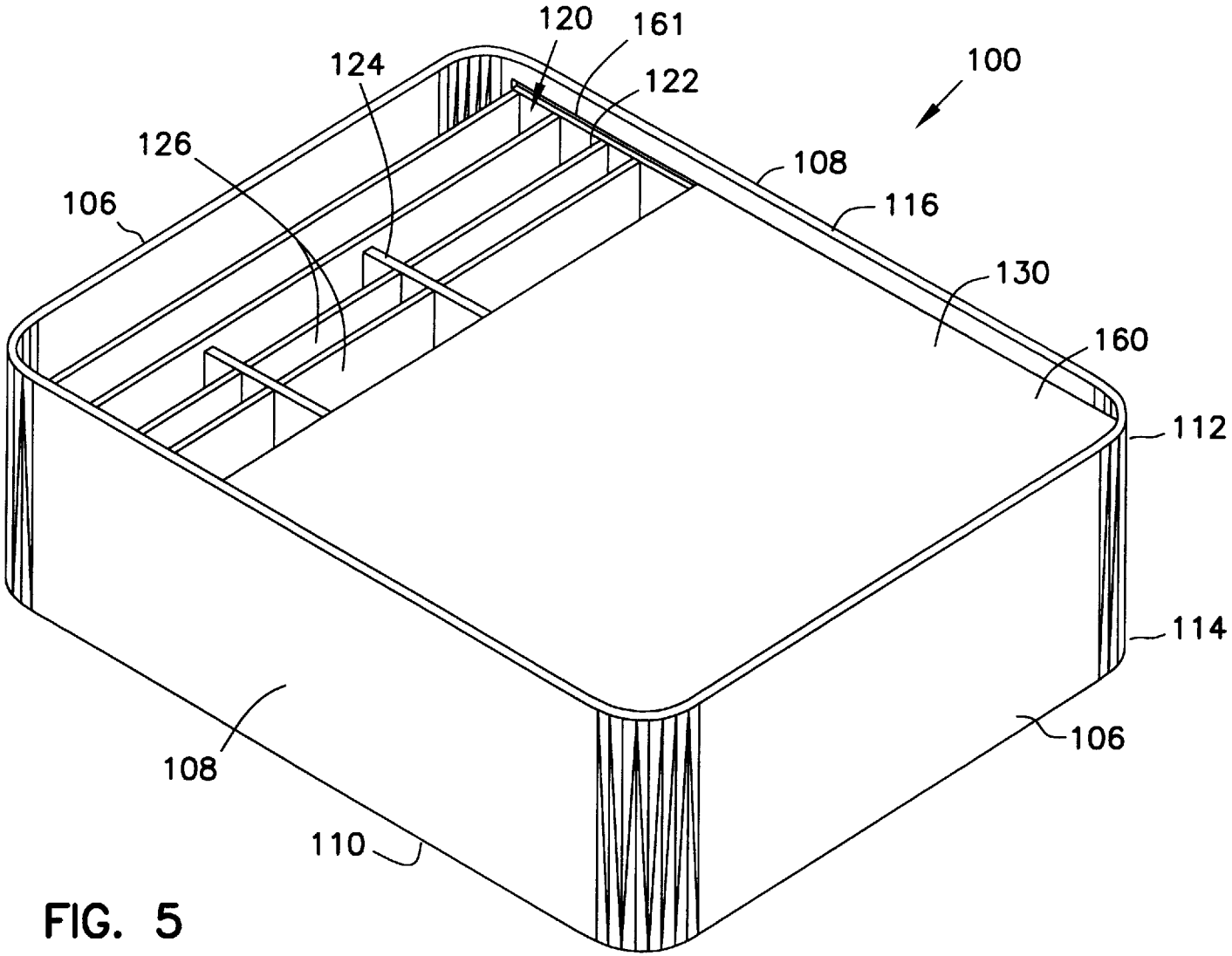
FIG. 5 is a perspective view illustrating a portable tote container constructed in accordance with yet another embodiment of the present invention.
Figure 6:
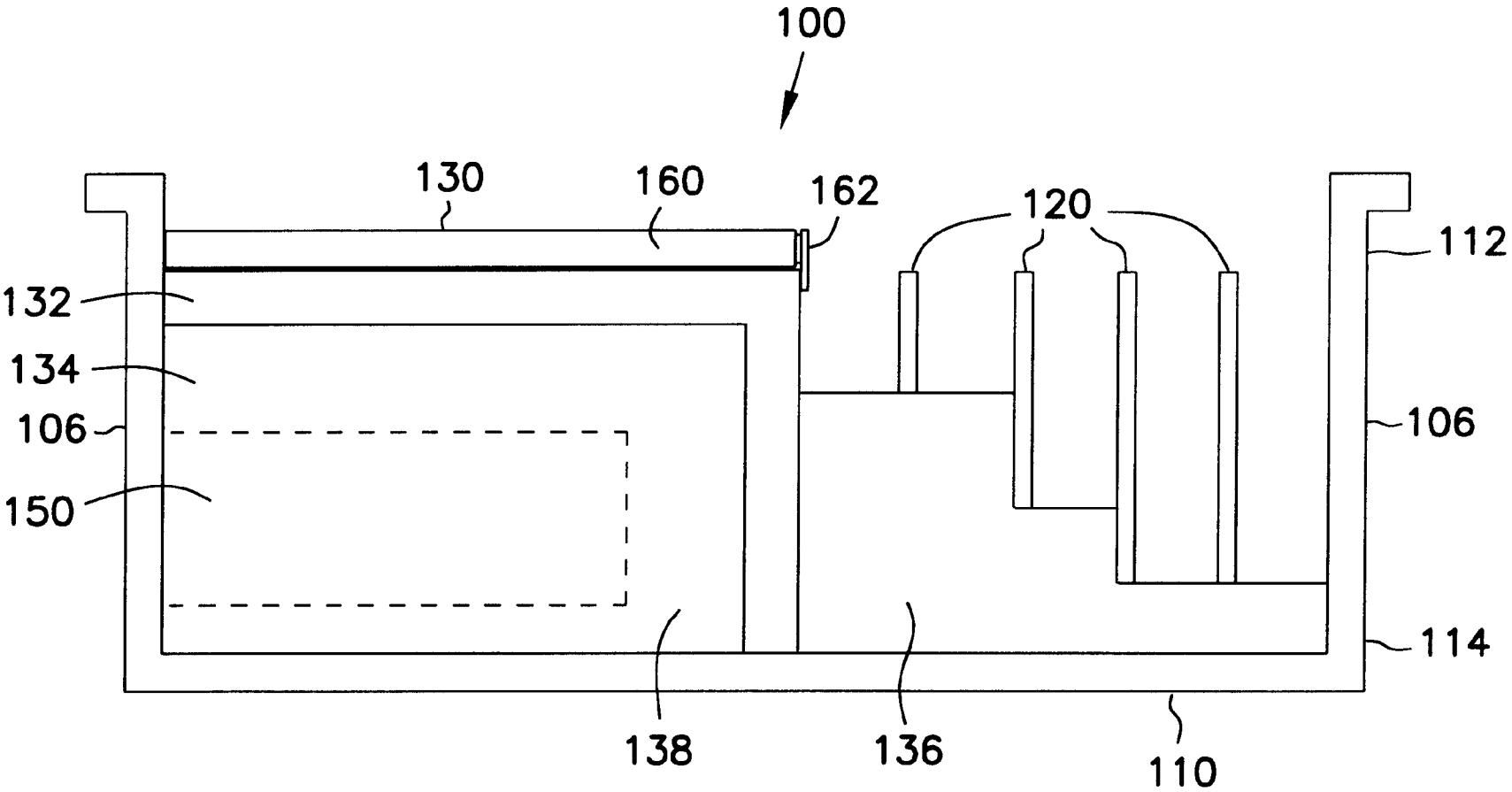
FIG. 6 is a cross-sectional view illustrating the portable tote container illustrated in FIG. 5.

FIGS. 5 and 6 illustrate another embodiment of the portable tote container 100. In this embodiment, the portable tote container 100 has a first set of side surfaces 106, a second set of side surfaces 108 and a bottom surface 110, as discussed in the previous embodiments. The portable tote container 100 has dividers 120 and a work surface panel 130 disposed therein. In this configuration, the work surface panel 130 comprises the support material 134, top layer material 132 and a door panel 160. The door panel 160 is movably disposed within the portable tote container 100. In one embodiment, the door panel 160 is slidably coupled with the portable tote container 100 and slides across the top layer of material to cover the dividers 120. In another embodiment, the door panel 160 slides within a track 161 to provide a movable work surface within the portable tote container 100.

As the door panel 160 is slid over the dividers 120, the top layer of material 132 forms a new work surface area. Alternatively, in another embodiment, the door panel 160 hinges at hinge point 162. The movable door panel 160 gives an operator increased flexibility with respect to increasing the surface area of the work surface. The door panel 160 also allows a user to cover the space between the dividers 120 when access to the space is unnecessary. In addition, the ridge 131 prevents parts from rolling off of the work surface 130. The door panel 160 can also be comprised of antistatic foam for use with the electronic parts.

Advantageously, the portable tote container has a work surface coupled therewith so that an operator will have sufficient work space. In addition, the raised level of the work surface raises the surface to a level which is easier to work at. A further benefit is that an operator has access to an anti-static work surface without having to worry about finding an appropriate surface. The work surface also provides a less abrasive surface on which to assemble parts, where the work surface will not scratch or damage the new parts. This feature is particularly important for devices which are repeatedly flipped during the assembly process or devices which are particularly delicate. The cavity also provides temporary storage for assemblies which have only been partially assembled, or components which are too large for the dividers 120.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A portable tote box, comprising:

a main body having a top surface, a plurality of side surfaces and a bottom surface where the bottom surface connects a lower portion of the side surfaces;

at least one divider panel removably disposed within said main body, the divider panel forming at least one space between the divider panel and one of the side surfaces; and a work surface panel adapted for assembling components thereon, the work surface panel disposed within said main body, the work surface panel disposed adjacent to the divider panel such that an operator has access to the work surface panel and at least one space created by the divider panel;

wherein the divider panel is removably coupled with the work surface panel.

2. The portable tote box as recited in claim 1, wherein the top surface, a plurality of side surfaces and a bottom surface form an open box.

3. The portable tote box as recited in claim 1, further comprising a ridge disposed around the work surface panel.

4. The portable tote box as recited in claim 1, wherein the work surface panel is disposed adjacent to the divider panel such that an operator has simultaneous access to the work surface panel and at least one space created by the divider panel.

5. The portable tote box as recited in claim 1, wherein the work surface panel is removably coupled with the main body.

6. The portable tote box as recited in claim 1, wherein the work surface panel is secured to at least the bottom surface of the main body.

7. The portable tote box as recited in claim 1, wherein the divider panel is generally perpendicular to the bottom surface and the work surface panel is substantially parallel to the bottom surface.

8. The portable tote box as recited in claim 1, wherein the work surface panel is recessed away from the top surface and toward the bottom surface of the main body.

* * * * *